US006314832B1

(12) United States Patent
Graber et al.

(10) Patent No.: US 6,314,832 B1
(45) Date of Patent: Nov. 13, 2001

(54) FRICTION CONTROL MECHANISM

(75) Inventors: Stephen P. Graber, Lakewood; Stephen A. Harris, Montclair, both of CA (US)

(73) Assignee: Adams Rite Manufacturing Co., Pomona, CA (US)

( * ) Notice: Subject to any disclaimer, the term of this patent is extended or adjusted under 35 U.S.C. 154(b) by 0 days.

(21) Appl. No.: 09/363,806

(22) Filed: Jul. 30, 1999

(51) Int. Cl.[7] ..... G05G 5/06
(52) U.S. Cl. ..... 74/531; 74/523
(58) Field of Search ..... 74/531, 527, 523

(56) References Cited

U.S. PATENT DOCUMENTS 2,542,423 * 2/1951 Metzger ..... 74/531
2,552,726 * 5/1951 Larson ..... 74/531
3,987,687 * 10/1976 Bland et al. ..... 74/531
4,018,104 * 4/1977 Bland et al. ..... 74/531
4,833,938 * 5/1989 Reinwall et al. ..... 74/531 X
5,394,767 * 3/1995 Hoblingre et al. ..... 74/531 X

* cited by examiner

*Primary Examiner*—Mary Ann Green
(74) *Attorney, Agent, or Firm*—William W. Haefliger

(57) ABSTRACT

Apparatus to provide controlled frictional resistance to cyclic displacement of a member, comprising a base, a friction part frictionally and slidably engagable with base, in response to displacement of member, at least one spring element transmitting force acting to hold part in frictional engagement with the base, one of friction part and base having a friction surface engaged with the other of part and base, and characterized in that the force to overcome friction between the base and part remains substantially constant over a large number of displacement cycles of the member.

16 Claims, 5 Drawing Sheets

2
13
13a
13b
3
43
12
52
13a
14
53
44
44a
47
46
45
54
2
3

FRICTION CONTROL MECHANISM

BACKGROUND OF THE INVENTION

This invention relates generally to frictional resistance to relative displacement of members, and more particularly to controlled frictional resistance to cyclic displacement of one member relative to another.

There is need for improvements in devices which provide frictional resistance to relative displacement of members, considering the difficulty of controlling transitions between static friction (existent before the members are relatively displaced) and sliding friction (existent while the members are undergoing relative displacement). Such transitions occur, for example, during cyclic (back and forth) movement of such members. Experience has shown that the force needed to effect cyclic back and forth movement between frictionally interengaged members tends to increase and then decrease over a range of cycling, under the static and sliding friction conditions occurring during each cycle, as referred to. Such force increases and decreases transmitted through associated mechanism can and do increase the wear, and reduces the lives, of such mechanism.

What is needed is a means to reduce or substantially eliminate such force increase and decrease, needed to cyclically displace one member relative to another over a large number of cycles, which the members are frictionally interengaged.

SUMMARY OF THE INVENTION

It is a major object of the invention to provide a solution to the above described problems. The present invention meets the need referred to, and is embodied in apparatus to provide controlled frictional resistance to cyclic displacement of a member, comprising a) a base b) a friction part remaining frictionally and slidably engaged with said base, in response to cyclic displacement of said member, c) at least one spring element transmitting force acting to hold said part in frictional engagement with said base, d) one of said friction part and base having a friction surface engaged with the other of said part and base, and characterized in that the force to overcome friction between the base and part remains substantially the same over a large number of displacement cycles of said member, for example up to 300,000 minimum.

Accordingly, the solution to the problem as described is embodied in a friction surface on at least one of the part and base that will maintain substantially constant the force required to overcome static and sliding friction, over a large number of cycles of the part relative to the base.

Another object is to provide the friction surface on the movable part, and which has an associated coefficient of friction less than 0.15, and which will maintain friction constant, in use.

Yet another object is to provide the friction surface to consist of a DELRIN related thermoplastic material, as for example the material known commercially as FULTON 404, a product of LNP Corporation, Malvern, Pa.

A further object is to provide the spring element to comprise a stack of BELLEVILLE washers operating to provide constant force holding the part in engagement with the base.

An additional object is to provide a pivot mounting the movable part to pivot relative to the base, and a thrust bearing between at least one of the spring and the pivot. The thrust bearing, for example includes a series of anti-friction needle bearings spaced about an axis defined by the pivot. A spring force adjustment component may be provided, and may comprise a nut threadably engaging a shaft on which the pivot, spring or springs, and thrust bearing are carried.

These and other objects and advantages of the invention, as well as the details of an illustrative embodiment, will be more fully understood from the following specification and drawings, in which:

DRAWING DESCRIPTION

DETAILED DESCRIPTION

Figure 3:
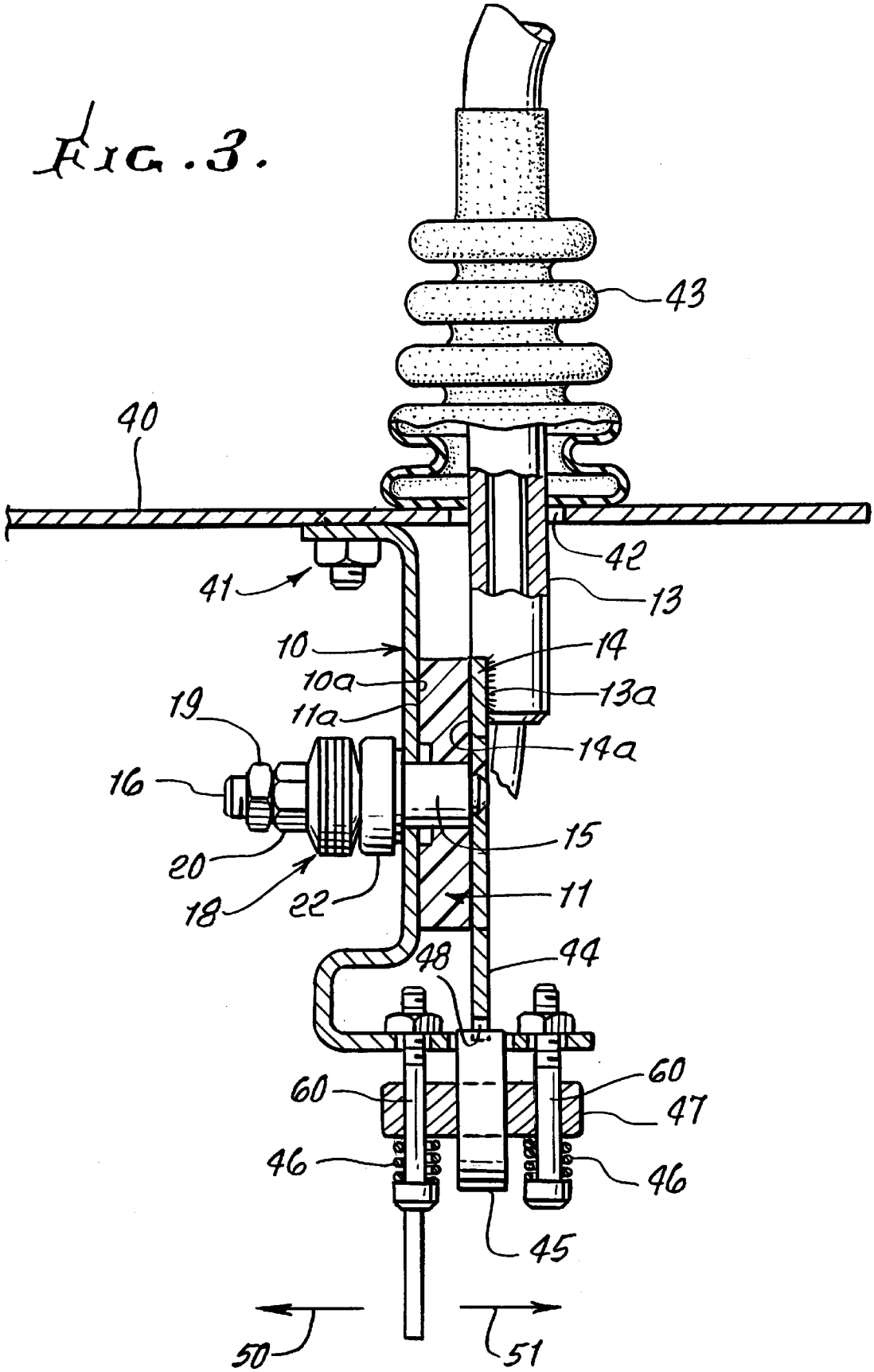
FIG. 3 is an enlarged section taken in elevation on lines 3—3 of FIG. 1.
Figure 4:
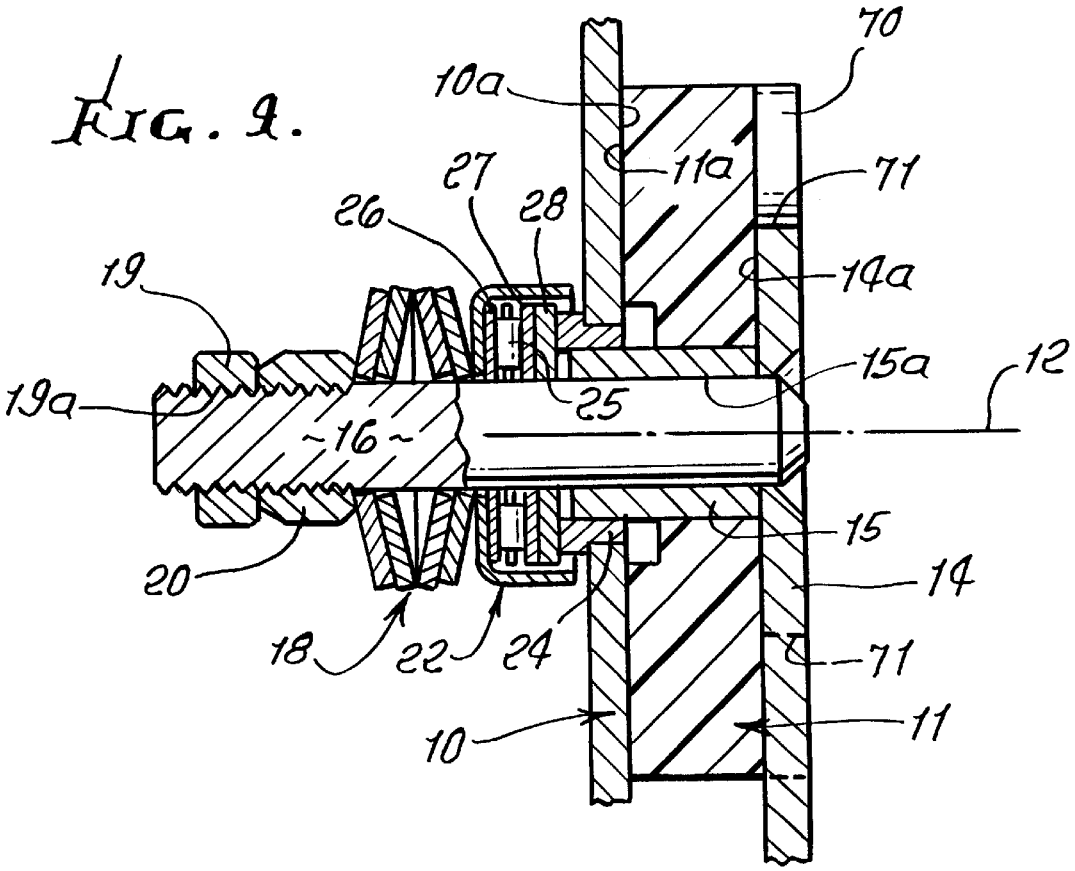
FIG. 4 is an enlarged section taken on lines 4—4 of FIG. 2.
Figure 5:
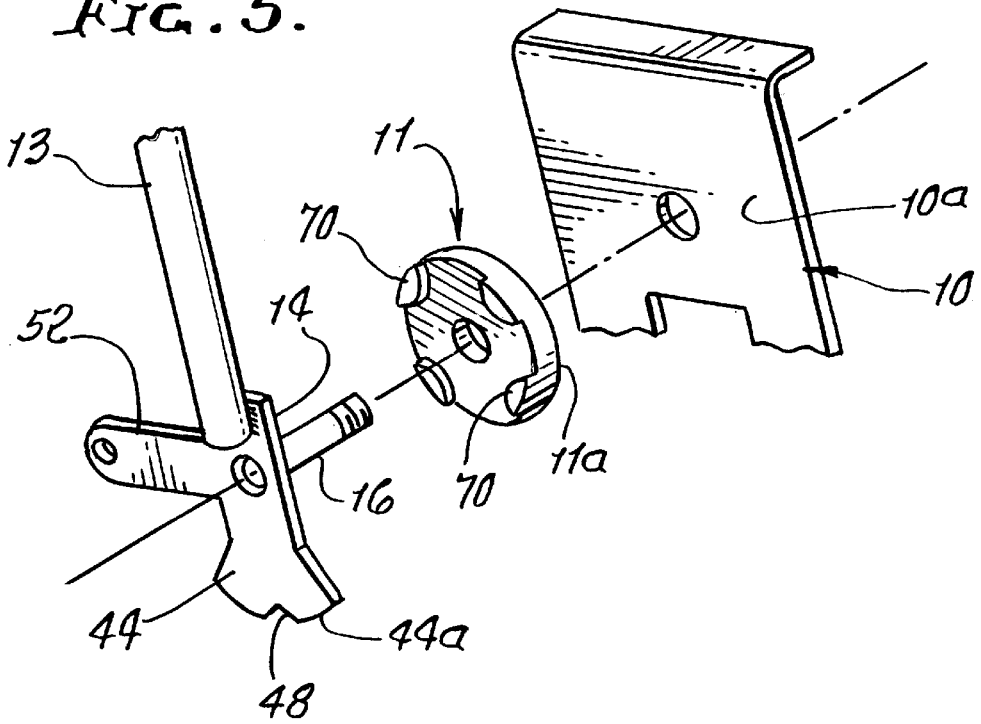
FIG. 5 is an exploded perspective view of elements of FIG. 4.

Referring first to FIG. 4, it shows a fixed position base plate 10, and a friction part, such as a disc 11, having a surface 11*a* frictionally and slidably engageable with the surface 10*a* of the base plate. In the example, the surface 11*a* is rotatable about pivot axis 12, for example in response to rotation of handle 13 about the axis. See FIG. 3. The handle is attached at 13*a* to a carrier plate 14 to which disc 11 is attached, at 14*a*. Plate 14 is attached to a stainless steel sleeve 15 having a bore 15*a* that receives a shaft 16 on which the sleeve rotates. Base plate 10 is preferably hard chrome plated, and particularly to define flat friction surface 10*a* that engages the flat surface 11*a* of the disc 11. Elements 10–16 may take various forms, their purpose being to provide for frictionally selectively slidable inter-engagement of surfaces 10*a* and 11*a*. The FIG. 4 construction is preferred.

A spring element is also provided to transmit force acting to hold surfaces 10*a* and 11*a* in frictional inter-engagement. In the example, as seen in FIG. 4, shaft 16 is urged to the left by Belleville spring stack 18. Jam nut 19 in threaded engagement with the shaft at 19*a* and lock nut 20, is holds the spring stack in compression, between the lock nut and a cup 22, the jam nut, lock nut, spring stack and cup being rotatable together with the shaft 16, plate 14, disc 11 and handle 13, about axis 12.

The stainless steel sleeve 15 which also rotates with the shaft, serves to center the shaft, and is carried by a non-rotary annular bearing 24, which is in turn carried by the base plate 10. Reaction thrust loading is transmitted by the rotary cup 22 to the bearing 24 via an annular set of needle bearings 25 extending radially relative to axis 12. Those bearings are positioned, axially, between a rotary thrust washer 26 and a non-rotary thrust washer 27, in the cup as shown, there being an additional non-rotary thrust and spacer washer 28 between 27 and 24. Accordingly, a parallel relationship is maintained between surfaces 10*a* and 11*a*, for controlled frictional interengagement.

It is an important and outstanding feature of the invention that one of the the friction part and base has a friction surface engaged with the other of the part and base and characterized in that the force to overcome static and sliding friction between the base and part remains substantially constant over a large number of displacement cycles of handle member 13, for example from 0 to 300,000 (minimum) back and forth cycles. In the example, the friction surface is on the disc 11, and referred to above as 11*a*. That surface has an associated coefficient of friction between about 0.04 and 0.15; and it typically consists of a material that includes a DELRIN related thermoplastic. For best results, that material consists of the product identified as FULTON 404, a product of LNP Corporation, Malvern, Pa., or equivalent. The desirable feature of that material is the substantially unchanged holding (friction) force resisting rotation or movement relative to the base against which it is clamped, over thousands of cycles of back and forth movement between HOLD positions, such input movement being transmitted for example by an actuator such as handle 13.

Additional features of the illustrated apparatus include an upper plate 40 supporting the base plate 10 at connection 41; and an opening 42 in plate 40 through which handle 13 projects. A boot 43 encompasses the handle extent immediately above the opening 42, as shown. Even though base plate 10 may deflect in directions 50 or 51, the friction surfaces 10*a* and 11*a* are held in predetermined clamped condition by the assembly, including springs 18. Rotation of nuts 19 and 20 adjusts the clamp-up. This allows ready assembly of the assembly to different support plates 40.

Figure 1:
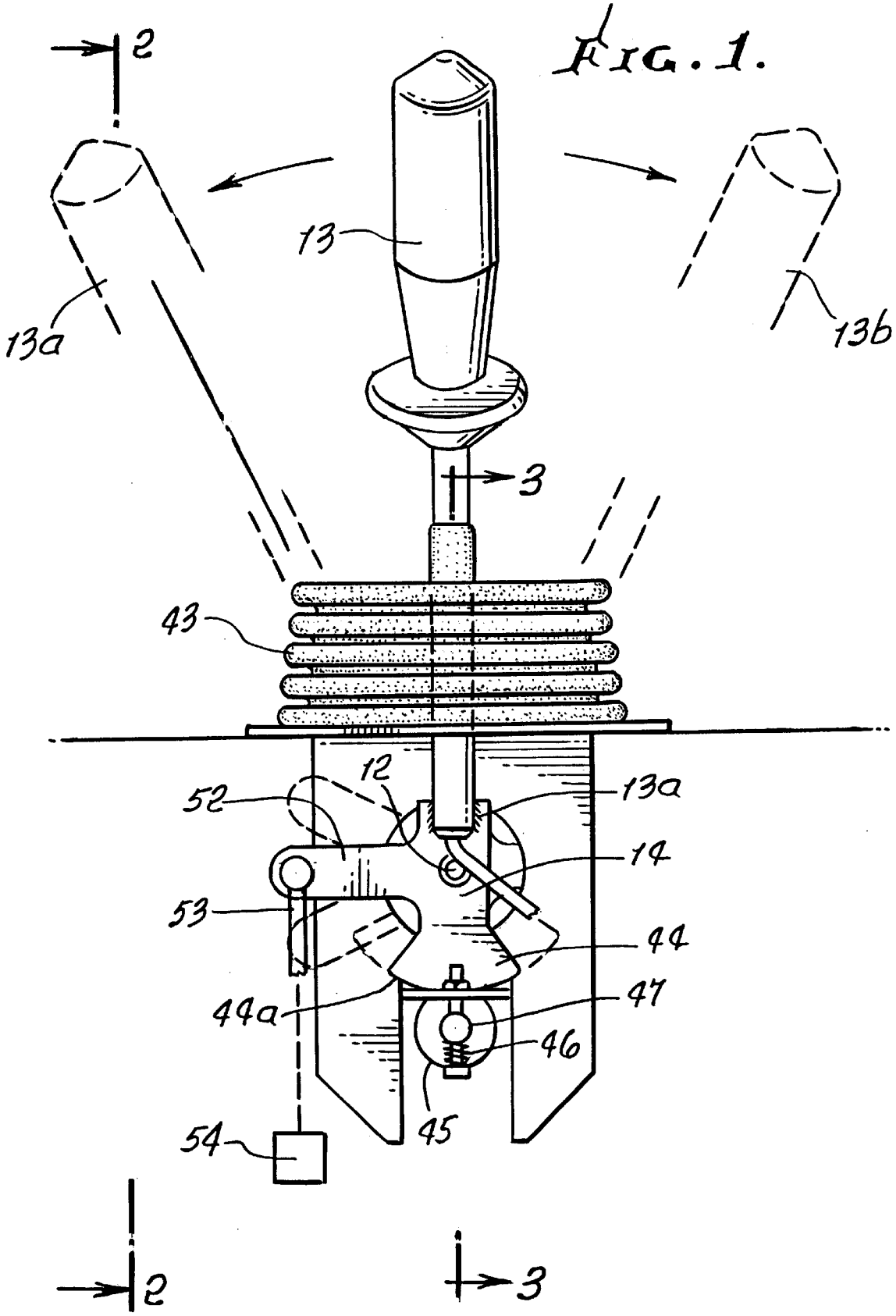
FIG. 1 is a side elevation of friction control mechanism incorporating the invention.
Figure 2:
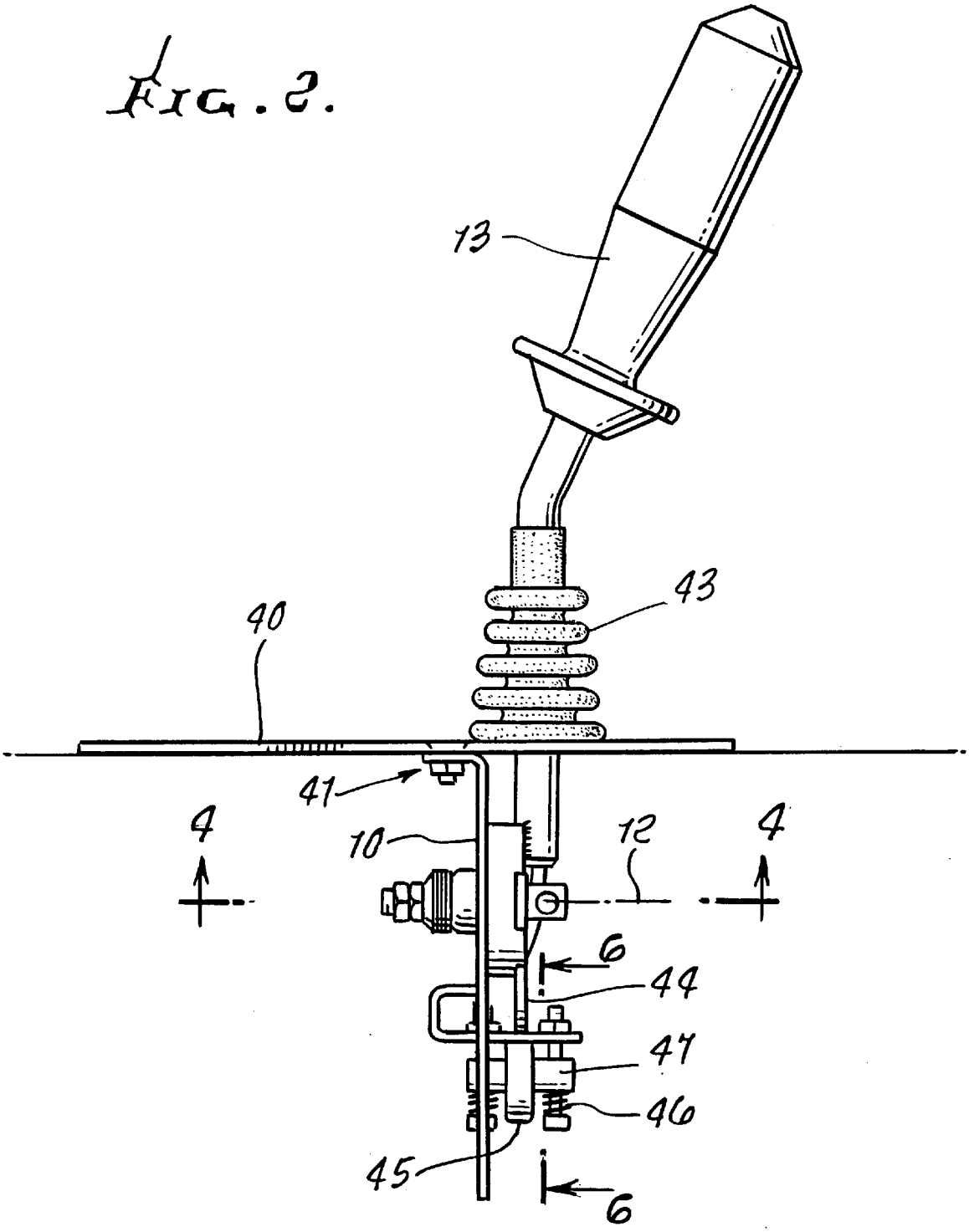
FIG. 2 is a front elevation taken on lines 2—2 of FIG. 1.
Figure 6:
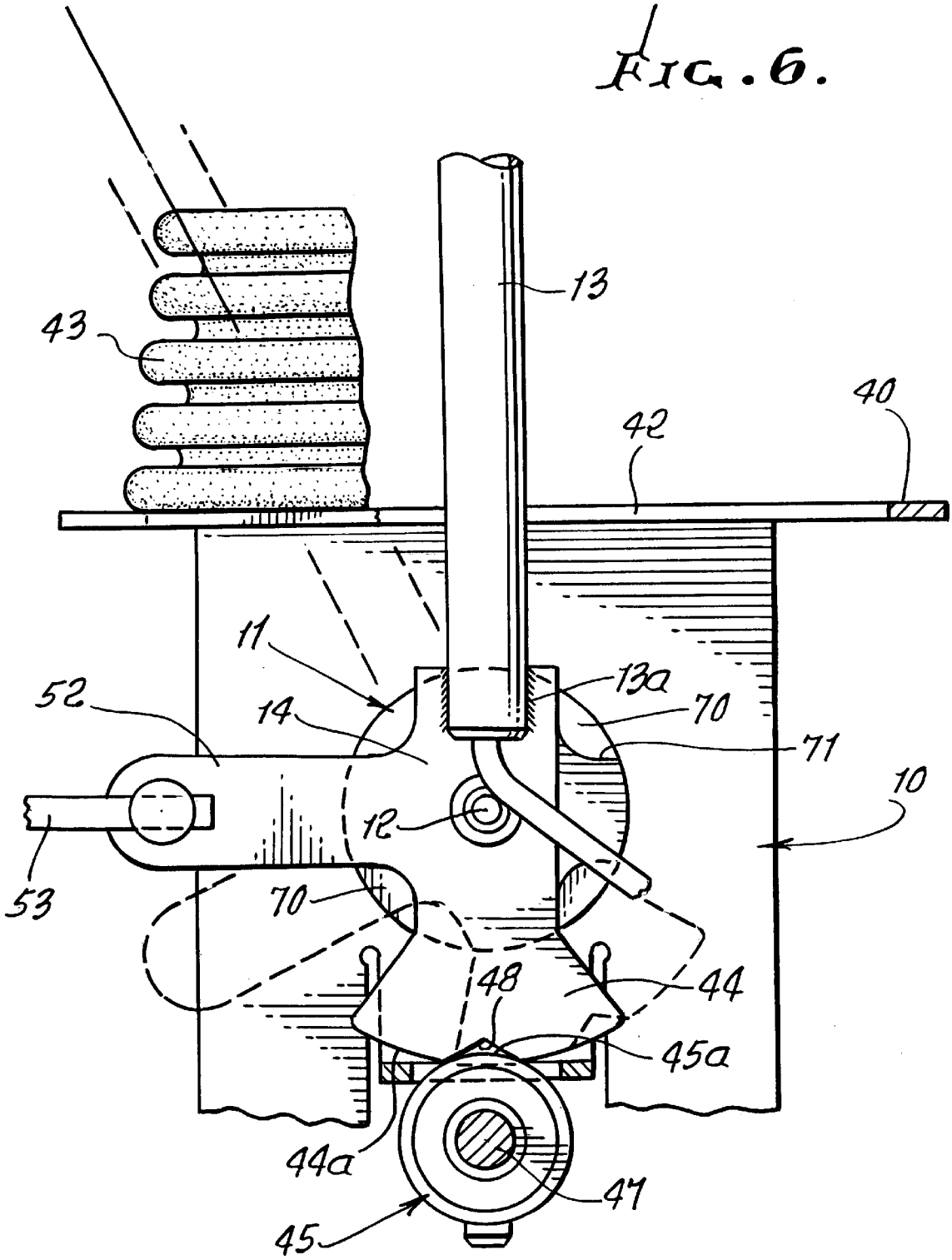
FIG. 6 is an enlarged view showing detenting of elements of FIG. 1 and is taken on lines 6—6 of FIG. 2.

Lower extent 44 of the carrier plate 14 defines a downwardly convex edge 44*a* that rides on the surface 45*a* of a circular detent bearing 45. That bearing is urged upwardly by springs 46 engaging the underside of a bearing support 47, that slides vertically on bolt shanks 60. A detent is provided by a notch 48 in 44 that receives a portion of the bearing surface 45*a* when the lever or handle extends vertically, as shown in FIG. 6. This establishes a predetermined handle position relative to upper plate 40. FIG. 1 shows handle forward and rearward extreme positions 13*a* and 13*b*, at which positions the handle is maintainable by friction of the disc 11 engagement with base plate 10, as described. Even though the surface 11*a* of the disc means, the holding force at position 13*a* and 13*b* remaining substantially constant.

An actuator projection 52 integral with plate 14 is connected with a rod 51 that extends to auxiliary mechanism 54 operated by handle movement, as described.

Studs 70 integral with disc 11 facilitate its connection to plate 24, as via openings 71 in that plate.

As shown, and described, sleeve 15 provides for pivoting of one of the part and base relative to the other. Also, thrust bearing 14 transmits thrust operable to urge said surfaces of said part and base into surface to surface frictional interengagment, as amended. Also, the sleeve extends within a bore defined by the friction part.

We claim:

1. Apparatus to provide controlled frictional resistance to cyclic displacement of a member comprising a) a base, b) a friction part frictionally and slidably engagable with said base, in response to displacement of said member, c) at least one spring element transmitting force acting to hold said part in frictional engagement with said base, d) one of said friction part and said base having a friction surface engaged with a surface of the other of said part and said base, and characterized in that the force to overcome friction between the base and the part remains substantially constant over thousands of displacement cycles of said member, e) there being i) a sleeve to provide for pivoting of one of said part and said base relative to the other, and ii) a thrust bearing to transmit thrust operable to urge said surface of said part and said base into surface to surface frictional interengagement, iii) whereby said sleeve and said thrust bearing coact to maintain said surfaces in face to face parallel relation despite wear of said friction part, f) and said friction surface extending about the sleeve and consisting of a non-metallic material.

2. The apparatus of claim 1 wherein said friction surface is on said one part.

3. The apparatus of claim 1 wherein said friction surface has an associated coefficient of friction less than 0.15, and which will maintain friction constant, in use.

4. The apparatus of claim 1 wherein said at least one spring element comprises a Belleville washer or washers.

5. The apparatus of claim 1 including a spring force adjustment component.

6. The apparatus of claim 1 wherein said base has a friction surface that consists of hard chrome plate.

7. The apparatus of claim 1 wherein said friction surface is positioned so that the frictional resistance to said force is constant irregardless of time and the relative velocity of said base and said part.

8. The apparatus of claim 1 including a support carrying said base which comprises a plate, at a location allowing plate deflection.

9. The apparatus of claim 8 wherein said support contains an opening passing said member which is a handle carrying said friction part.

10. The apparatus of claim 1 including a pivot mounting said part to pivot relative to said base.

11. The apparatus of claim 10 wherein said thrust bearing includes a series of needle bearings spaced about an axis defined by said pivot.

12. The apparatus of claim 11 including a spring element force adjustment component, and there being a shaft carrying said at least one spring, and said spring force adjustment component.

13. The apparatus of claim 12 wherein said component comprises a nut threadably engaging said shaft to transmit force acting to adjustably compress said spring element.

14. The apparatus of claim 12 wherein the sleeve consists of stainless steel extending about said shaft and centering the shaft.

15. Apparatus to provide controlled frictional resistance to cyclic displacement of a member comprising a) a base, b) a friction part frictionally and slidably engagable with said base, in response to displacement of said member, c) at least one spring element transmitting force acting to hold said part in frictional engagement with said base, d) one of said friction part and said base having a friction surface engaged with a surface of the other of said part and said base, and characterized in that the force to overcome friction between the base and the part remains substantially constant over thousands of displacement cycles of said member, e) there being i) a sleeve to provide for pivoting of one of said part and said base relative to the other, and ii) a thrust bearing to transmit thrust operable to urge said surface of said part and said base into surface to surface frictional interengagement, iii) whereby said sleeve and said thrust bearing coact to maintain said surfaces in face to face parallel relation despite wear of said friction part, f) and wherein said friction surface extends about the sleeve and consists of a material that includes a thermoplastic material.

16. Apparatus to provide controlled frictional resistance to cyclic displacement of a member comprising a) a base, b) a friction part frictionally and slidably engagable with said base, in response to displacement of said member, c) at least one spring element transmitting force acting to hold said part in frictional engagement with said base, d) one of said friction part and said base having a friction surface engaged with a surface of the other of said part and said base, and characterized in that the force to overcome friction between the base and the part remains substantially constant over thousands of displacement cycles of said member, e) there being i) a sleeve to provide for pivoting of one of said part and said base relative to the other, and a ii) thrust bearing to transmit thrust operable to urge said surface of said part and said base into surface to surface frictional interengagement, iii) whereby said sleeve and said thrust bearing coact to maintain said surfaces in face to face parallel relation despite wear of said friction part, f) and wherein the sleeve extends within a bore defined by the friction part.

* * * * *